US006216360B1

(12) United States Patent
Wertheim

(10) Patent No.: US 6,216,360 B1
(45) Date of Patent: Apr. 17, 2001

(54) DEVICE FOR HEATING DYES TO TINT OPTICAL LENSES

(76) Inventor: Herbert A. Wertheim, 4470 SW. 74 Ave., Miami, FL (US) 33155

( * ) Notice: Subject to any disclaimer, the term of this patent is extended or adjusted under 35 U.S.C. 154(b) by 0 days.

(21) Appl. No.: 09/443,981

(22) Filed: Nov. 19, 1999

(51) Int. Cl.[7] ..... F26B 3/34

(52) U.S. Cl. ..... 34/266; 34/586; 34/60; 264/1.36; 118/479; 351/162; 8/636

(58) Field of Search ..... 34/266, 268, 586, 34/60, 61, 90, 202; 264/1.36, 1.38, DIG. 46; 118/667, 400, 429; 351/159, 162; 8/506, 611, 636

(56) References Cited

U.S. PATENT DOCUMENTS 5,052,337 10/1991 Talcott .

5,665,420 * 9/1997 Janssen et al. ..... 427/2.12

OTHER PUBLICATIONS

BPI Catalog (www.callbpi.com), 1999.*

* cited by examiner

*Primary Examiner*—Stephen Gravini

(57) ABSTRACT

A device that utilizes a method to heat dyes to color plastic lenses. The device is an electrically heated outer tank containing a heat transfer medium. An inner tank containing a dye solution is placed in side the outer tank. Lenses are placed in the dye solution along with sensor probes and microprocessor control to maximize dye diffusion into the lenses and minimize boil over of the tanks. Spill containment and agitation stirring are also features which enhance diffusion of dye into the lenses while minimizing boil over.

1 Claim, 2 Drawing Sheets

DEVICE FOR HEATING DYES TO TINT OPTICAL LENSES

BACKGROUND—FIELD OF THE INVENTION

The invention relates to a device used by professionals within the optical and ophthalmic industry to heat dyes to a specific temperature to color plastic lenses.

Within the optical lens manufacturing industry, it has been a widespread practice to color plastic lenses after manufacture in accordance with the customer's preference. Numerous devices have been used for this purpose. The most common is a type that utilizes a double tank system. The outer tank is heated electrically and contains a heat transfer medium. The inner tanks, which contain dye, are immersed in the heat transfer medium which indirectly heats each tank of dye. The dyes used in this process are prone to crystallization, decomposition and sediment formation. The double tank system reduces this tendency. Optical dyes only diffuse well into plastic lenses within a narrow temperature range (200–210° F.). The temperature of double tank system has proven hard to control precisely.

BACKGROUND—DESCRIPTION OF PRIOR ART

An examination of the various kinds of equipment available to the optical/ophthalmic industry reveals that instruments of the type under discussion are available. However, these other systems are without the unique features of the present device. The only device found which was similar to the present device was patented by Talcott et al., U.S. Pat. No. 5,052,337. However, that device does not incorporate the unique infrared radiant heating system, the unique solid state temperature sensor probes, nor the unique spill containment system of the present device.

OBJECTS AND ADVANTAGES

Accordingly, several objects and advantages of the present device are:

(a) to heat the lenses in the dye as well as the dye solution itself using radiant infrared and conductive heating thus enhancing the diffusion of the dye into the lens and producing a higher quality lens with deeper dye penetration;

(b) to heat the lenses and the dye solution without the use of heat transfer media;

(c) to eliminate the problems associated with direct heating. Specifically, dye crystallization, decomposition and sediment formation;

(d) to precisely control the temperature of the dye through microprocessors and individual beaker sensor probes;

(e) to provide spill containment for any dye which boils out of the beakers.

DRAWING FIGURES

REFERENCE NUMERALS IN DRAWINGS

Figure 1:
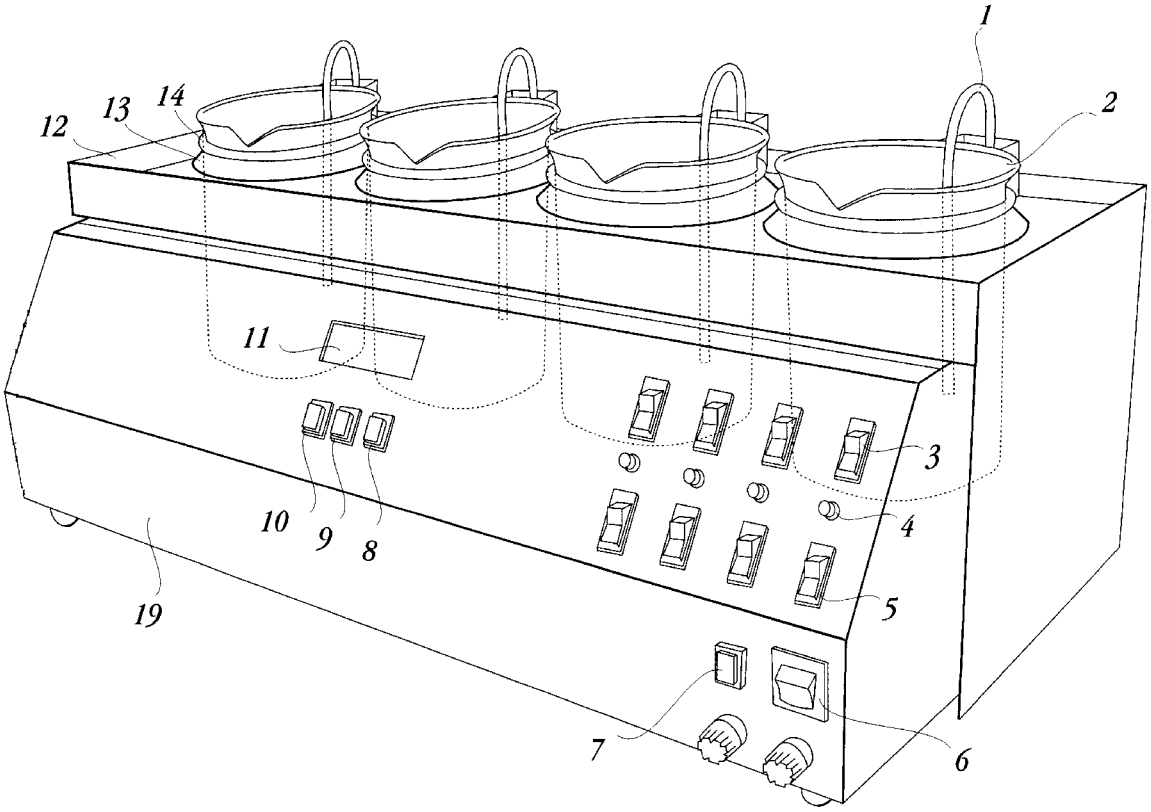
FIG. 1 shows a perspective view of the device, showing significant elements.
Figure 2:
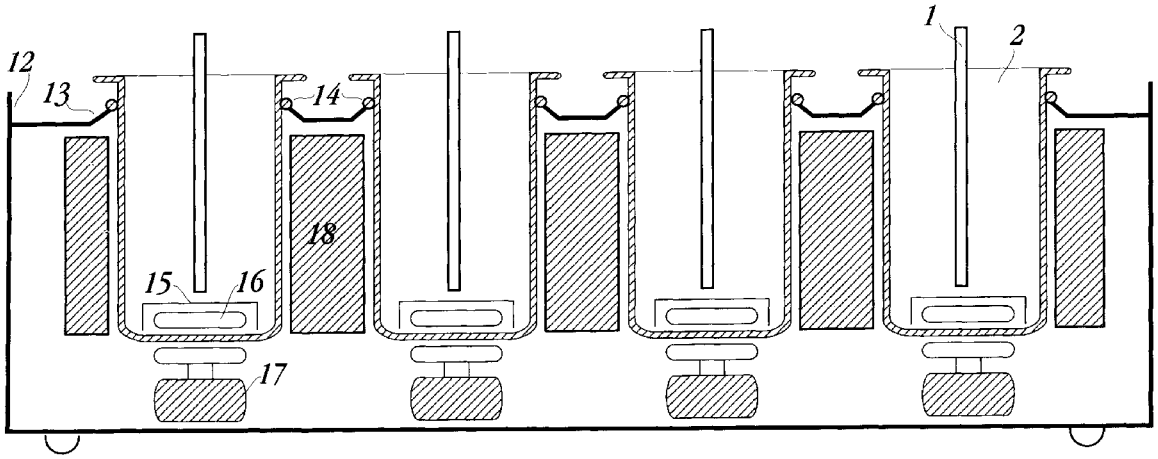
FIG. 2 shows a cross section of the device, showing significant elements.

1. Temperature sensor probes
2. Glass beakers that contain dye solution
3. On-off switches for stirrer motors
4. Infrared radiant heating on-off indicators

5. On-off switches for infrared radiators
6. Main power switch
7. Microprocessor reset button
8. Button to lower set temperature
9. Button to raise set temperature
10. Beaker select button
11. Display panel to show beaker 2 status
12. Spill containment basin with angled surfaces 13 to mate with seals around beakers 14
13. Angled surfaces within basin 12 to contain spilled fluid
14. Seals around beakers
15. Perforated metal cover over stirring bar to keep lenses away from it
16. Magnetic stirrers inside beakers
17. Stirrer motors with magnets
18. Ceramic infrared radiating elements that surround the glass beakers 2
19. Microprocessor assembly connected to a temperature sensor probe 1 in each beaker 2

DESCRIPTION

The device consists of five basic parts.

1. Glass beakers 2 that contain the dye solution and allow radiant infrared and conductive heating.

2. Spill containment basin 12 with angled surfaces 13 to mate with beaker seals 14 and retain fluid in the basin 12.

3. Ceramic infrared radiators 18 that heat the dyes and lenses through the sides of the glass beakers 2.

4. A stirring system 15, 16, 17 that keeps the dye solution in constant agitation.

5. A microprocessor control 19 which monitors the temperature using a sensor probe 1 in each beaker 2.

OPERATION

The glass beakers 2 are filled with the dye solution and the device is heated up to the correct operating temperature. The glass beakers 2 allow heating of the dyes and lenses by conduction and infrared radiation from the ceramic radiators 18. The microprocessor 19 monitors the temperature in each beaker 2 using a dedicated temperature sensing probe 1 in each beaker 2 These probes 1 employ a solid state temperature sensing device (such as an Analog Devices AD 590) enclosed within a stainless steel capped tube and sealed using a rubber sealant. The microprocessor 19 controls the heating process and maintains an accurate temperature to within several degrees. The microprocessor displays 11 the current temperature in each tank along with its set temperature. When the device reaches the optimal set temperature for the lenses and the dye, the lenses are lowered into the dye solution. Coloring of the lens typically takes place within a few minutes. As operation near the boiling point of the dye solution may be desired, the spill containment system 12, 13, 14 is always in place to contain the dye solution and keep it away from the heating elements 18 in the event of a boil-over of the dye solution.

SUMMARY, RAMIFICATIONS, AND SCOPE

Accordingly, the reader will see that the device will allow an improved method of coloring optical lenses. The device significantly improves the accuracy of maintaining temperature and the direct heating method eliminates the chemicals used as a heat transfer medium. The method of heating has been designed to heat both the lenses and the dyes through the side of the glass beaker using radiant infrared and conductive heating. The bulk of the dye is then heated, not just the surface of a tank containing the dye. This unique design eliminates the crystallization problems associated with the dye materials. If these materials settle to the bottom of a beaker which is heated from below, they may be burned and crystallized. If they contact the side of a tank which is heated solely by conduction from the side, they may also be burned and crystallized. In addition, the constant agitation of the dye further helps prevent sediment formation that leads to burning and crystallization of the dyes. The agitation also maintains a uniform high concentration level of the dye around the lens, which increases the diffusion rate of the dye. The agitation reduces the violence of boiling, so that higher temperatures close to boiling may be used safely. This also increases the diffusion rate of the dye into the lens.

The microprocessor controls the temperature of individual beakers, which may be set at any temperature from ambient to 220° F. The unique spill containment basin with beaker seals retains any boiled over dye solution, preventing burning of that solution on the infrared heating elements. The combination of side heating using infrared and conductive heating through glass into the dye, agitation, spill containment and precise temperature control result in an improved system for coloring plastic lenses.

I claim:

1. A device for drying, heating, and/or coloring lenses comprising:

an electrically, infrared and conductive heating means to heat said lenses placed in a dye containing inner tank such that said infrared and conductive heating means enhances diffusion of dye solution into a lens for deeper dye penetration;

microprocessor temperature control means with individual temperature sensor probes to precisely monitor dye temperature to eliminate burning or crystallization of said dye solution;

spill containment means such that dye boiling from said tank is contained;

stirring means keeping said dye solution in constant agitation such that sediment formation prevents the burning or crystallization of said dye solution along with maintaining a uniform high concentration level of the dye around the lenses for higher temperature treatment and higher rates of diffusion of dye into the lenses.

* * * * *